US005542478A

United States Patent [19]

Heiple

[11] Patent Number: 5,542,478

[45] Date of Patent: Aug. 6, 1996

[54] COMBINATION SLOPER AND TAILGRADER ATTACHMENT FOR VEHICLES

[75] Inventor: Ashley Heiple, Alum Bank, Pa.

[73] Assignee: Rockland, Inc., Bedford, Pa.

[21] Appl. No.: 283,938

[22] Filed: Aug. 1, 1994

[51] Int. Cl.[6] ..... E02F 3/76

[52] U.S. Cl. ..... 172/782; 172/786

[58] Field of Search ..... 37/219, 231, 268, 37/281; 172/4.5, 445.2, 459, 667, 742, 781, 782, 788, 799, 799.5, 815

[56] References Cited

U.S. PATENT DOCUMENTS

| | | | |
|---|---|---|---|
| 2,646,633 | 7/1953 | Jahn | 172/782 |
| 2,659,988 | 11/1953 | Braden et al. | 172/782 |
| 2,847,772 | 8/1958 | McMullen | 172/781 X |
| 2,876,564 | 3/1959 | Briscoe | 172/782 X |
| 3,049,822 | 8/1962 | McMullen | 172/782 |
| 3,061,956 | 11/1962 | Braden | 172/782 |
| 3,203,120 | 8/1965 | Burton | 172/782 |
| 3,242,599 | 3/1966 | Iverson | 172/782 |

*Primary Examiner*—Terry Lee Melius
*Assistant Examiner*—Robert Pezzuto
*Attorney, Agent, or Firm*—Lalos & Keegan

[57] ABSTRACT

An attachment for a vehicle generally consisting of a support frame mountable on the vehicle, a swing frame pivotally mounted on the support frame about an axis disposed laterally of a longitudinal centerline of the vehicle when the support frame is mounted on the vehicle, the swing frame being angularly displaceable relative to the support frame, a moldboard universally mounted on the swing frame, the support frame and the moldboard operatively connected for angularly displacing the moldboard relative to the swing frame about a first axis and a second operative connection for angularly displacing the moldboard relative to the swing frame about a second axis.

51 Claims, 3 Drawing Sheets

COMBINATION SLOPER AND TAILGRADER ATTACHMENT FOR VEHICLES

BACKGROUND OF THE INVENTION

This invention relates to grading machines and more particularly to an attachment for a wheeled vehicle having a moldboard that may be positioned selectively for backsloping, frontsloping and tailgrading operations, and transporting the moldboard when not in use.

One type of conventional grading machine consists of a rigid frame mounted on a pair of wheel units, an engine and operator's cab mounted on the frame just forward of a rear wheel unit and a grader moldboard mounted on the underside of the frame between the operator's cab and a front wheel unit. Typically, the grader moldboard may be angled and adjusted vertically to provide various grading operations on level terrain such as a roadway, a runway and the like. For grading on sloping terrain, it has been the practice to provide a slope grading attachment for such machines which generally consists of a moldboard having an inner end thereof connected to a rear end of the machine with the moldboard projecting laterally and downwardly of the machine, and a pull bar interconnecting an outer free end of the sloper moldboard and either a forward portion of the machine frame or an outer end portion of the grader moldboard. An example of such type of machine and sloping attachment is disclosed in U.S. Pat. No. 2,847,772 to Wayne W. McMullen.

In a modification of the type of grader machine described, there is provided an articulated frame including a rear frame section mounted on a rear wheel unit and supporting an engine and the operator's cab, a front frame section mounted on a front wheel unit and supporting a depending grader moldboard. Sloping attachments mounted on such articulated machines typically consist of a moldboard connected at an inner end to the rear frame section of the machine, and a pull bar interconnecting an outer free end of the sloper moldboard and either the front frame section of the machine or an outer end portion of the grader moldboard.

Such types of machines, however, have several disadvantages. Because of the manner of use of pull bars, the sloper moldboard cannot be positioned for tailgrading or backsloping. If the pull bar is connected at or adjacent the free end of the sloper moldboard, it is difficult if not impossible to position the free end of the sloper moldboard close to standing objects such as telephone poles, road signs, guard rail posts and the like or under guard rails to perform slope grading. Where the pull bar is connected to the grader moldboard, it is not possible to simultaneously perform level grading and slope grading operations unless the fixed angular relationship of the grader and sloper moldboards is suitable for the task being performed or the length of the pull bar is adjustable. Furthermore, where the machine is of the articulated type, it is not possible to perform simultaneous level grading and slope grading operations without locking out the articulated front end section of the machine.

More recently, there has been developed in the prior art a sloping attachment of the type described in which the conventional pull bar interconnecting the sloper and grader moldboards is eliminated and an outer portion of the sloper moldboard is connected through an extensible link to a support frame of the sloper attachment. In such type of arrangement, the orientation of the sloper moldboard may be adjusted independent of the grader moldboard. An example of such type of attachment is disclosed in U.S. Pat. No. 3,049,822 to Wayne W. McMullen. In such type of sloper attachment, however, it has been found that the sloper moldboard cannot be maneuvered sufficiently to position it effectively in backsloping, frontsloping, tailgrading and transporting positions, and further to orient the sloper moldboard in each of such positions to provide a desired operating or storage attitude of the sloper moldboard. Such prior art type of attachment further has been found to be deficient in that it does not adequately provide for positioning the sloper moldboard sufficiently laterally of the vehicle during backsloping and frontsloping operations to permit the vehicle to traverse on level terrain such as a roadway, or provide for positioning the sloper moldboard sufficiently adjacent the wheeled vehicle to provide a compact arrangement of the sloper attachment when the attachment is not in use and is being transported along a roadway or otherwise.

Accordingly, it is the principal object of the present invention to provide an improved ground working attachment for a wheeled vehicle.

Another object of the present invention is to provide an improved attachment for a wheeled vehicle operable to provide slope grading functions.

A further object of the present invention is to provide an improved attachment for a wheeled vehicle capable of performing level and slope grading functions.

A still further object of the present invention is to provide an improved attachment for a wheeled vehicle which is operable to provide backsloping, frontsloping and tailgrading functions.

Another object of the present invention is to provide a sloper attachment for a conventional grader machine.

A further object of the present invention is to provide an improved sloper attachment for a grader machine provided with a grader moldboard in which a sloper moldboard of the attachment may be adjusted and operated independently of the grader moldboard.

A still further object of the present invention is to provide an improved attachment for a wheeled vehicle capable of performing backsloping, frontsloping and tailgrading operations in which the vehicle may be driven on level terrain such as a roadway during a sloping operation.

Another object of the present invention is to provide an improved attachment for a wheeled vehicle capable of performing backsloping, frontsloping and tailgrading operations in which a sloping blade thereof may be positioned sufficiently adjacent a side of the vehicle to provide a compact arrangement of the attachment to facilitate the transportation of the attachment when not in use and being transported from one site to another.

A still further object of the present invention is to provide a sloper attachment mountable on a conventional grader machine which can be readily detached from the machine by removing a set of connecting pins and disconnecting several hydraulic lines equipped with quick disconnect fittings.

Another object of the present invention is to provide an improved sloper attachment for a grader machine which can be positioned in cooperation with a grader moldboard to spread material dozed by take grader moldboard, in a single pass of the machine thus increasing the productivity of the machine.

A further object of the invention is to provide an improved sloper attachment for an articulated grader machine which can be positioned in a tailgrading position and cooperate with the grader moldboard of the machine in a sideshifted position to provide a wide grading swath corresponding to the combined lengths of the cooperating grader and sloper moldboards.

Another object of the invention is to provide an improved sloper attachment for a conventional grader machine which is capable of performing slope grading operations close to standing objects such as telephone poles, road signs, guard rail posts and culverts and under guard rails and the like.

A further object of the present invention is to provide an improved combination sloping and grading attachment for a wheeled vehicle which is relatively simple in design, comparatively easy to manufacture and easy to operate.

Other objects and advantages of the present invention will become more apparent to those persons having ordinary skill in the art to which the present invention pertains from the following description taken in conjunction with the accompanying drawings in which:

DETAILED DESCRIPTION

Figure 1:
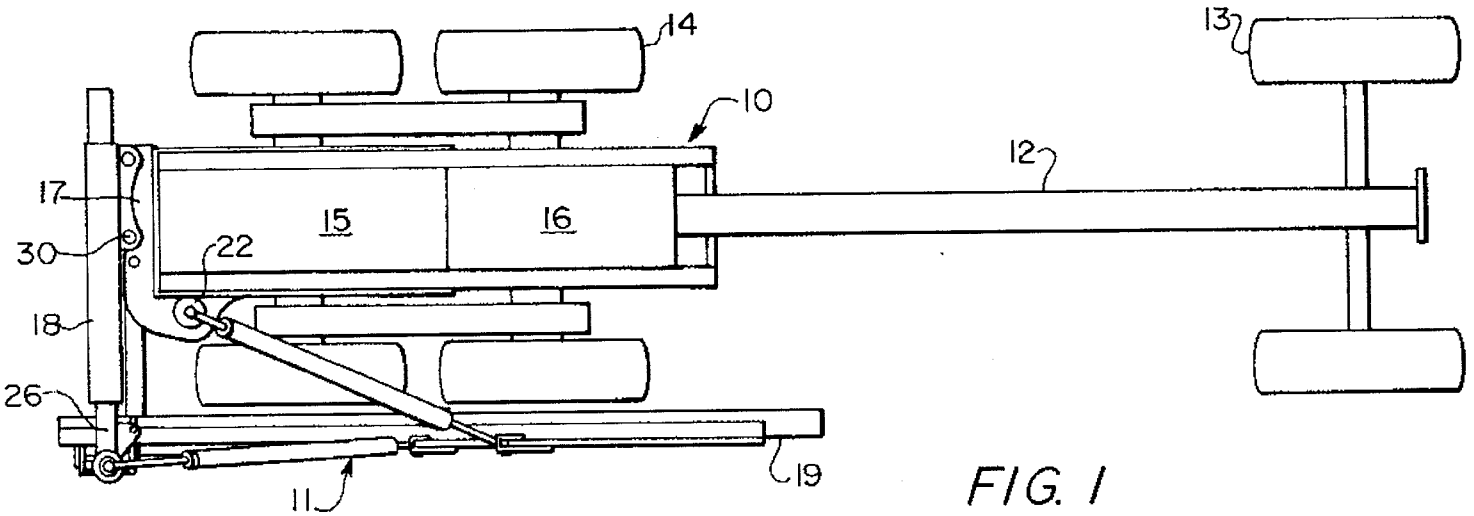
FIG. 1 is a top plan view of a conventional grading machine provided with a level and slope grading attachment embodying the present invention, in which the attachment is shown in a transporting condition.

Referring to the drawings, there is illustrated a conventional grading machine 10 on which there is mounted a level and slope grading attachment 11 embodying the present invention. The machine includes a frame 12, a front wheel unit 13, a rear wheel unit 14, an engine 15 and an operator's cab 16 provided with conventional controls for operating the vehicle and the attachment. The attachment is adapted to be detachably secured to the rear end of the vehicle frame and generally includes a support frame 17, a swing frame 18 and a moldboard 19.

Figure 5:
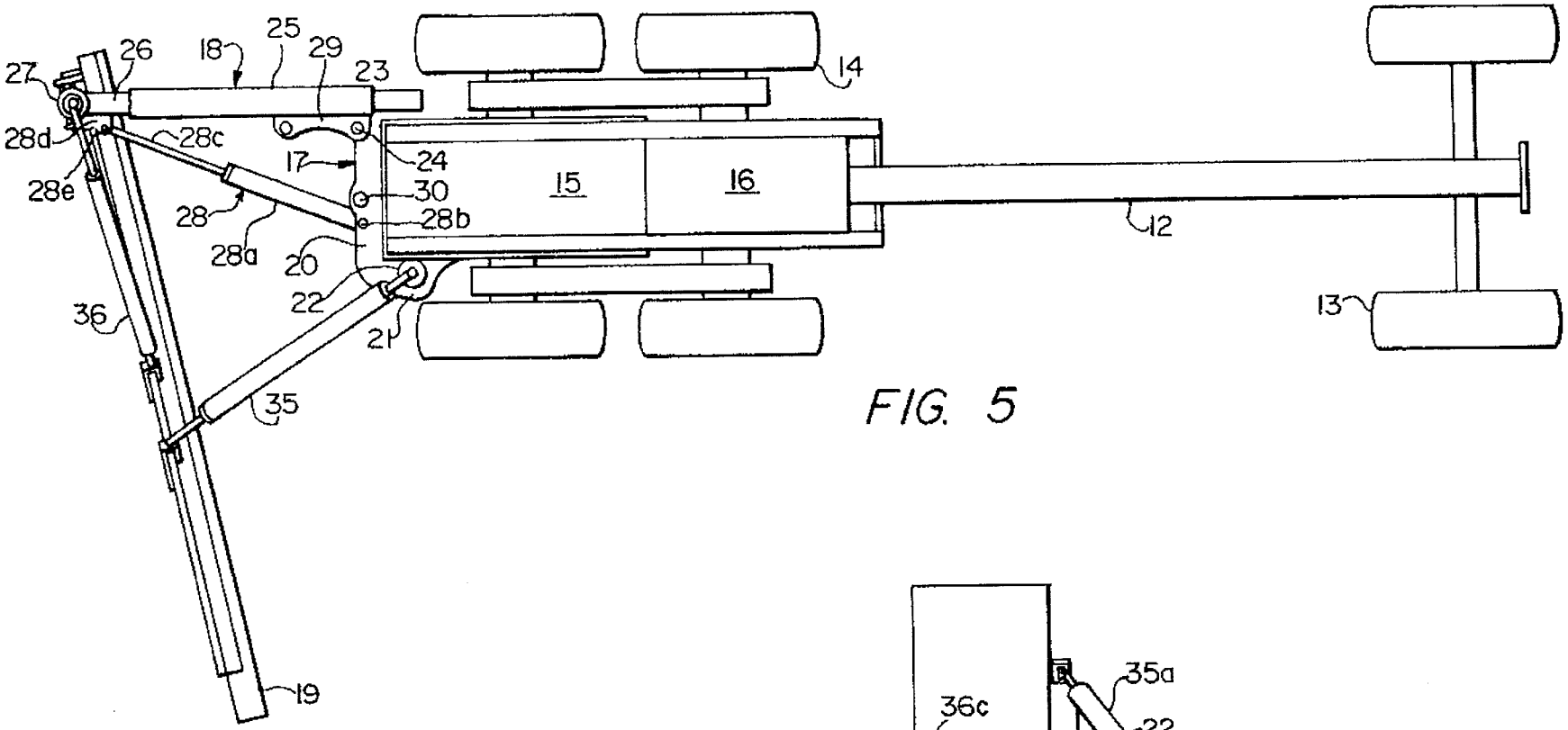
FIG. 5 is a view similar to the view shown in FIG. 1, illustrating the attachment in a tailgrading condition.

As best shown in FIG. 5, support frame 17 includes a section 20 adapted to be positioned transversely across the rear end of the vehicle frame and detachably secured thereto by means of pins or any other suitable means, a section 21 projecting a short distance along a side of the vehicle frame to provide a substantially L-shaped support frame member, and a post section 22 formed integrally with frame section 21 and projecting upwardly along a side of the engine compartment of the vehicle. Swing frame 18 includes a frame section 23 pivotally connected to the support frame 17 by means of a pin 24 having a vertical pivot axis disposed laterally relative to the longitudinal centerline of the vehicle, a channel beam section 25 formed integrally with frame section 23 and an extendable beam 26 disposed telescopically within beam section 25. The outer end of beam 26 is provided with an upright hydraulic cylinder section 27 which is disposed substantially parallel to post section 22 of the support frame.

Angular displacement of the swing frame is provided by a cylinder assembly 28 including a cylinder member **28*a* pivotally connected to section 20 of the support frame as at 28*b* and a rod member 28*c* pivotally connected to a bracket 28*d* secured to extendable beam 26 as at 28*e*. When cylinder assembly 28 is retracted to position the swing frame in the position as shown in FIG. 1, an opening 29 in frame section 23 is adapted to register with an opening 30 in the support frame, permitting the insertion of a locking pin in the registered openings to lock the swing frame relative to the support frame, as shown in FIG. 1**.

Moldboard 19 includes a backing member 31 provided with a curved blade member 32 mounted on the front side thereof, having a lower cutting edge 33. An inner end of the backing member is connected to a lower end of a rod member 34 disposed within cylindrical post portion 27 for universal movement about a first axis coinciding with the axis of post portion 27 and a second axis disposed perpendicular to such first axis. Angular displacement of the moldboard about such first axis is provided by an angling cylinder assembly 35, and angular displacement of the moldboard about the second axis is provided by a pitch cylinder assembly 36. Cylinder assembly 36 includes a cylinder member 36a pivotally connected to a bracket **36*b* provided on the moldboard and a rod member 36*c* pivotally connected to the upper end of cylindrical post member 27 at an elevated point. Cylinder assembly 35 includes a cylinder member 35*a* pivotally connected to post portion 22 at an upper end thereof, and a rod member 35*b* pivotally connected to a bracket 35*c* provided on the moldboard between bracket 36*b* and the free end of the moldboard. Blade 33 may be displaced angularly relative to frame member 31** about the longitudinal axis of the moldboard to adjust the pitch of the blade.

A hydraulic system is provided on the vehicle with conventional controls disposed at the operator's station in the cab for operating the various hydraulically actuated mechanisms of the attachment to extend and retract the rod or extendable beam thereof and correspondingly position the moldboard into desired backsloping, frontsloping and tailgrading operating positions, and also in a storage or transport position as hereinafter described. The system is provided with a set of hydraulic hoses that are equipped with quick disconnect fittings located at the rear of the vehicle for easy connection to hydraulic hoses on the attachment connected to cylinder assemblies 27, 28, 35 and 36.

In the transport or storage condition, the attachment is adapted to be in the position as shown in FIG. 1 of the drawings. In such condition, swing cylinder assembly 28 is fully retracted to position the swing frame transversely, a locking pin is inserted in registered openings 29 and 30 to lock the swing frame to the support frame, extendable beam 26 is fully retracted to position the inner end of the moldboard in a position closest to the side of the vehicle, the pitch cylinder assembly is retracted to position the moldboard horizontally and the angling cylinder assembly is retracted to swing the moldboard alongside a set of wheels of the vehicle. In such condition, the attachment will be in a compact arrangement to facilitate the transport of the unit on the vehicle on public roadways or off road, the attachment may be stored on the vehicle or the attachment may be removed from the vehicle by placing suitable supports under the attachment, removing the pins connecting the attachment to the vehicle frame and driving the vehicle away.

Figure 3:
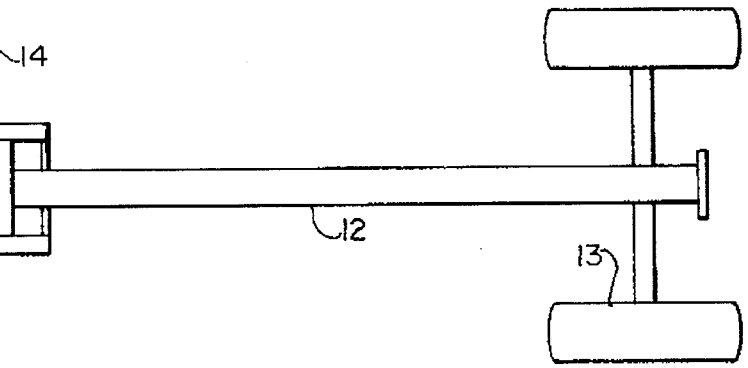
FIG. 3 is a top plan view similar to the view shown in FIG. 1, in which the blade or moldboard of the attachment is shown projecting laterally just prior to being pivoted downwardly into a slope grading condition.
Figure 4:
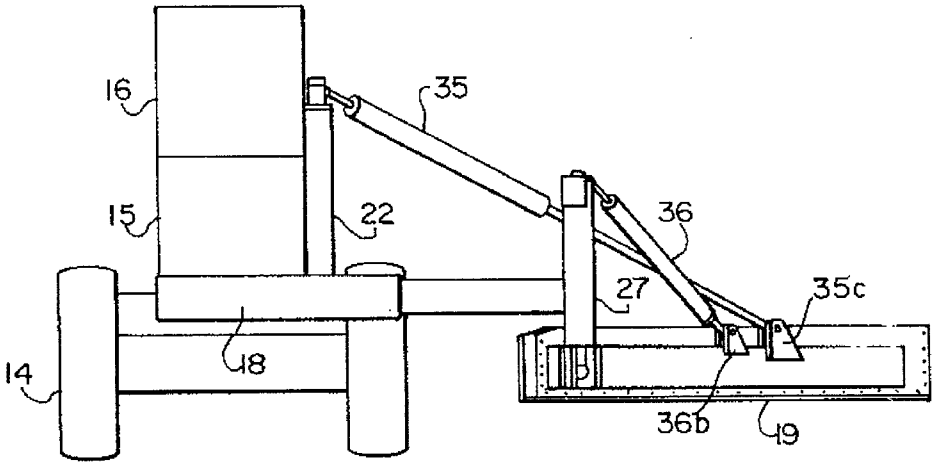
FIG. 4 is a rear view of the machine and attachment shown in FIG. 3.

To position the moldboard in a frontsloping position as shown in FIG. 3, starting with the attachment in the condition as shown in FIG. 1,, fluid under pressure is supplied to the base end of cylinder 28*a* to extend beam member 26 laterally, the base end of cylinder 35*a* to swing the moldboard outwardly away from the vehicle and the base end of cylinder 36*a* to pivot the moldboard downwardly. It will be appreciated that having the swing frame disposed transversely relative to the centerline of the vehicle and beam member 26 extended as shown in FIGS. 3 and 4, the vehicle is permitted to traverse over level terrain such as the side of a road while the slope grading is being performed, allowing better and faster operation of the vehicle. The locking of the swing frame to the support frame further provides additional support for the cantilevered moldboard and rigidity to the entire assembly.

Figure 2:
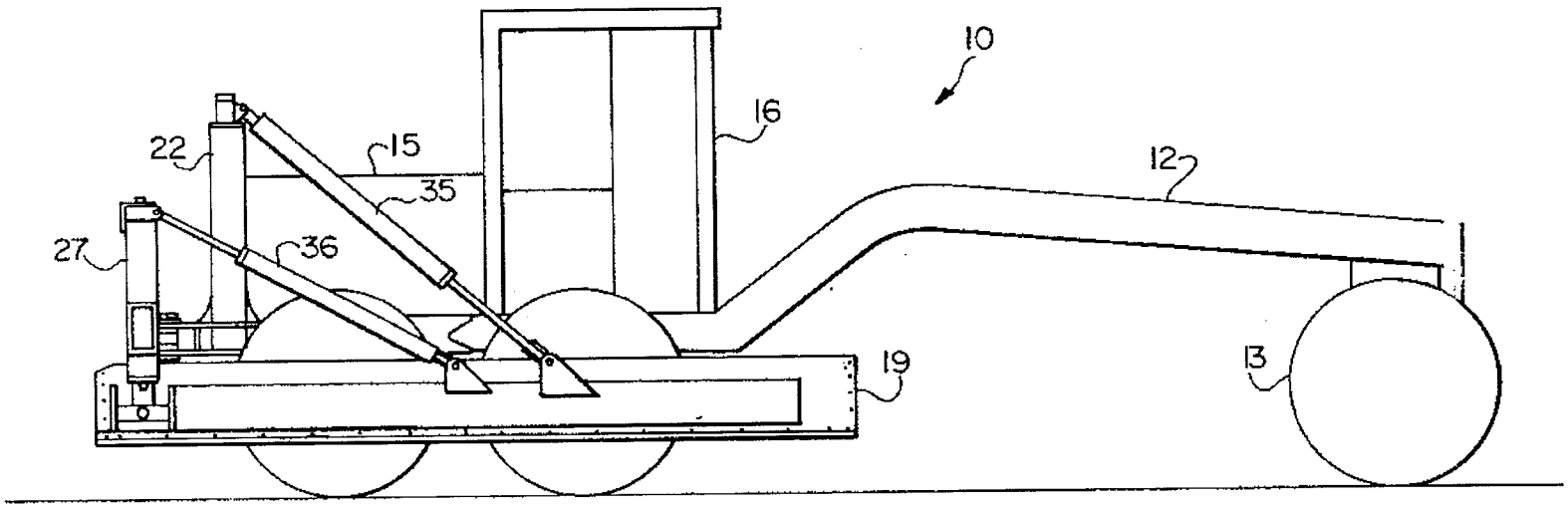
FIG. 2 is a side view of the machine and attachment shown in FIG. 1.

If it is desired to perform a backsloping operation, with the attachment in the condition as shown in FIGS. 1 and 2, the locking pin securing the swing frame to the support frame is removed to free the swing frame, fluid under pressure is supplied to the base end of cylinder 28*a* to angularly displace the swing frame relative to the support frame and then fluid under pressure is supplied to the rod end of cylinder member 36*a* to pivot the moldboard downwardly. The particular orientation of the moldboard is accomplished by controlling the various cylinder assemblies as described.

Figure 6:
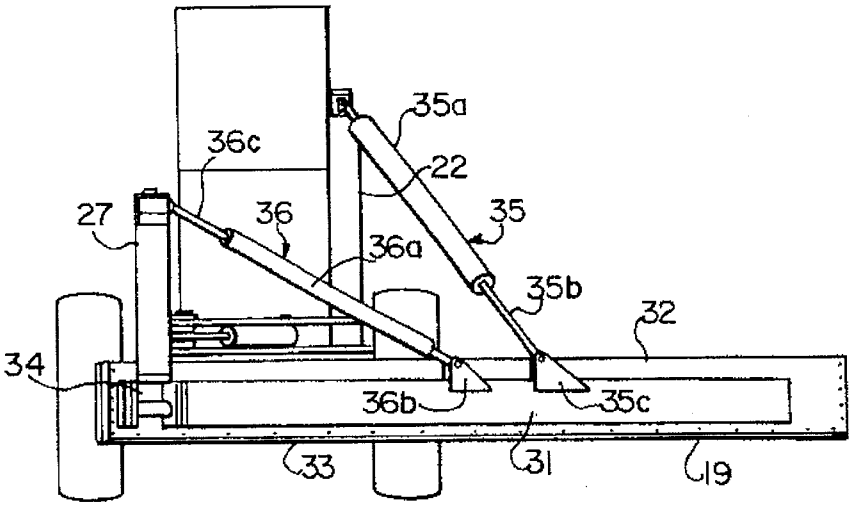
FIG. 6 is a rear view of the machine and attachment shown in FIG. 5.

To position the moldboard for a tailgrading operation, with the attachment in the condition as shown in FIGS. 1 and 2, locking pin 30 is removed freeing the swing frame, fluid under pressure is supplied to the base end of cylinder member 28*a* to angularly displace the swing frame relative to the support frame and into a position as shown in FIGS. 5 and 6, and then fluid under pressure is supplied to the base ends of cylindrical post portion 27, cylinder member 35*a* and cylinder 36*a* to lower the moldboard into engagement with the ground at the desired level. The attachment is then in position to have the vehicle move forward and perform a tailgrading operation.

In extending rod 28*c* to swing arm member 18 into the position shown in FIG. 5, the combined weight of the beam member and of the moldboard will prevent such beam member from extending under the force of rod 28*c*. Extension of the beam member, however, will occur when the arm member is in the locked position as shown in FIG. 1 or the fully swung position as shown in FIG. 5.

In any of the aforementioned frontsloping, backsloping and tailgrading operations, the pitch of the moldboard may be adjusted manually or mechanically as desired.

The attachment as described may be used with a conventional grading machine having either a rigid or articulated frame, and a grader moldboard mounted on the rigid frame forward of the operator's cab or on the articulated portion of the machine. It may be positioned as shown in FIG. 1 for transporting purposes and/or independent operation of the grader moldboard, positioned in any of the aforementioned frontsloping, backsloping or tailgrading positions for operation independent of the grader moldboard operation, positioned in either a frontsloping or backsloping position to perform a sloping operation while the grader moldboard is performing an independent grading operation, positioned in either a frontsloping or backsloping position and operated in conjunction with the grader moldboard to doze material laterally and spread and grade it on a slope, and positioned in a tailgrading position and operated in conjunction with a grader moldboard mounted on a sideshifted articulated frame of the vehicle to provide a wide grading swath corresponding to the combined lengths of the two moldboards.

The construction of the attachment further provides an improved productivity and greater maneuverability than conventional sloper attachments. The length varying feature of the arm member of the attachment not only permits the wheels of the vehicle to remain on level terrain while the sloper moldboard is performing a sloping operation, providing better control of the sloping operation and permitting the vehicle to advance at a faster speed, but permits the free end of the moldboard to be maneuvered around objects such as telephone poles, road signs, guard rails posts, culverts and the like. The length varying feature of the arm member further is advantageous in positioning the sloper moldboard closer to the vehicle when in the tailgrading position to provide better grader balance.

Although the attachment has been described in terms of providing a sloper moldboard on the arm member thereof for providing various sloping and grading functions, it further is contemplated to mount other tools or mechanisms on the extendable beam member such as snow plow wings and conveyor devices for lifting debris and other materials from ditches and the like.

It is contemplated that the various components of the attachment may consist of fairly simple fabricated forms and standard cylinder assemblies which may be easily assembled to facilitate the manufacture of the attachment.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An attachment for a vehicle comprising:

a support frame mountable on said vehicle;

a swing frame pivotally mounted on said support frame about an axis disposed laterally of a longitudinal centerline of said vehicle when said support frame is mounted on said vehicle;

means for angularly displacing said swing frame relative to said support frame;

a moldboard universally mounted on said swing frame;

means operatively interconnecting said support frame and said moldboard for angularly displacing said moldboard relative to said swing frame about a first axis; and means operatively interconnecting said swing frame and said moldboard for angularly displacing said moldboard relative to said swing frame about a second axis.

2. An attachment according to claim 1 wherein said support frame is detachably mountable on said vehicle.

3. An attachment according to claim 1 wherein said support frame includes a first section disposable on a rear end of said vehicle and a second section disposable on a side of said vehicle when said support frame is mounted on said vehicle.

4. An attachment according to claim 3 wherein said means for angularly displacing said moldboard relative to said swing frame about a said first axis is operatively connected to said support frame at an elevated point.

5. An attachment according to claim 1 wherein said support frame includes a post portion and said means for angularly displacing said moldboard relative to said swing frame about said first axis is operatively connected to said post portion.

6. An attachment according to claim 3 wherein said second section of said support frame includes a post portion and said means for angularly displacing said moldboard relative to said swing frame about said first axis is operatively connected to said post portion.

7. An attachment according to claim 1 wherein said means for angularly displacing said swing frame relative to said support frame is operable to displace said swing frame between a first position relative to said support frame and a second position angularly displaced from said first position.

8. An attachment according to claim 7 wherein said angular displacement between said first and second positions is 90°.

9. An attachment according to claim 7 wherein said first position is disposed adjacent said support frame and substantially transversely to a longitudinal centerline of the vehicle and said second position is disposed substantially parallel to the longitudinal centerline of the vehicle.

10. An attachment according to claim 7 including means for detachably securing said swing frame in said first position.

11. An attachment according to claim 1 wherein said means for angularly displacing said swing frame relative to said support frame comprises a hydraulically actuated cylinder assembly operatively interconnecting said support frame and said swing frame.

12. An attachment according to claim 1 wherein said means for angularly displacing said moldboard relative to said swing frame about said second axis is operatively connected to said swing frame at an elevated point.

13. An attachment according to claim 1 wherein said swing frame includes a post portion and said means for angularly displacing said moldboard relative to said swing frame about said second axis is operatively connected to said post portion.

14. An attachment according to claim 13 wherein said means for angularly displacing said moldboard relative to said swing frame about said second axis comprises a hydraulically actuated cylinder assembly operatively interconnected to said post portion at an elevated point and to said moldboard at a point intermediate the ends thereof.

15. An attachment according to claim 1 wherein said support frame includes a post portion and said means for displacing said moldboard relative to said swing frame about said first axis comprises a hydraulically actuated cylinder assembly operatively connected to said post portion at an elevated point and to said moldboard at a point intermediate the ends thereof.

16. An attachment for a vehicle according to claim 1 wherein said swing frame includes a horizontally disposed beam member pivotally connected to said support frame and a horizontally extendable beam section to which said moldboard is universally connected.

17. An attachment according to claim 16 wherein said support frame is detachably mounted on said vehicle.

18. An attachment according to claim 16 wherein said support frame includes a first section disposable on a rear end of said vehicle and second section disposable on a side of said vehicle when said support frame is mounted on said vehicle.

19. An attachment according to claim 18 wherein said means for angularly displacing said moldboard relative to said swing frame about said first axis is operatively connected to said support frame at an elevated point.

20. An attachment according to claim 16 wherein said support frame includes a post portion and said means for angularly displacing said moldboard relative to said swing frame is operatively connected to said post portion.

21. An attachment according to claim 18 wherein said second section of said support frame includes a post portion and said means for angularly displacing said moldboard relative to said swing frame is operatively connected to said post portion.

22. An attachment according to claim 16 wherein said means for angularly displacing said swing means relative to said support frame is operable to displace said swing frame between a first position relative to said support frame and a second position angularly displaced from said first position.

23. An attachment according to claim 22 wherein said angular displacement between said first and second positions is 90°.

24. An attachment according to claim 23 wherein said first position is disposed adjacent said support frame and substantially transversely relative to a longitudinal centerline of said vehicle and said second position is disposed substantially parallel to said longitudinal centerline of said vehicle.

25. An attachment according to claim 22 including means for detachably securing said swing frame in said first position.

26. An attachment according to claim 16 wherein said means for angularly displacing said swing frame relative to said support frame comprises a hydraulically actuated cylinder assembly operatively interconnecting said support frame and said horizontally extendable beam member of said swing frame.

27. An attachment according to claim 16 wherein said means for angularly displacing said moldboard relative to said swing frame about said second axis is operatively connected to said horizontally extendable beam member of said swing frame at an elevated point.

28. An attachment according to claim 16 wherein said horizontally extendable beam member of said swing frame includes a post portion and said means for angularly displacing said moldboard relative to said swing frame about said second axis is operatively connected to said post portion of the horizontally extendable beam member of said swing frame.

29. An attachment according to claim 27 wherein said means for angularly displacing said moldboard relative to said swing frame about said second axis comprises a hydraulically actuated cylinder assembly operatively interconnected to a post portion of said horizontally extendable beam member of said swing frame at said elevated point and to said moldboard at a point intermediate the ends thereof.

30. An attachment according to claim 16 wherein said support frame includes a post portion and said means for displacing said moldboard relative to said swing frame about said first axis comprises a hydraulically actuated cylinder assembly operatively connected to said post portion of said support frame at an elevated point and to said moldboard at a point intermediate the ends thereof.

31. An attachment according to claim 1 wherein said swing frame includes a horizontally disposed beam section angularly displaceable relative to said support frame, and a vertically extendable member mounted on said horizontally disposed beam section, to which said moldboard is universally connected, and including means for displacing said vertically displaceable member relative to said horizontally disposed beam section.

32. An attachment according to claim 31 wherein said support frame is detachably mounted on said vehicle.

33. An attachment according to claim 31 wherein said support frame includes a first section disposable on a rear end of said vehicle and a second section disposable on a side of said vehicle when said support frame is mounted on said vehicle.

34. An attachment according to claim 32 wherein said means for angularly displacing said moldboard relative to said swing frame about said first axis is operatively connected to said support frame at an elevated point.

35. An attachment according to claim 31 wherein said support frame includes a post portion and said means for angularly displacing said moldboard relative to said swing frame about said second axis is operatively connected to said post portion.

36. An attachment according to claim 33 wherein said second section of said support frame includes a post portion and said means for angularly displacing said moldboard relative to said swing frame about said first axis is operatively connected to said post portion.

37. An attachment according to claim 31 wherein said means for angularly displacing said swing means relative to said support frame is operable to displace said swing frame between a first position relative to said support frame and a second position angularly displaced from said first position.

38. An attachment according to claim 37 wherein said angular displacement between said first and second positions is 90°.

39. An attachment according to claim 37 wherein said first position is disposed adjacent said support frame and substantially transversely relative to a longitudinal centerline of said vehicle and said second position is disposed substantially parallel to said longitudinal centerline of said vehicle.

40. An attachment according to claim 37 including means for detachably securing said swing frame in said first position.

41. An attachment according to claim 31 wherein said means for angularly displacing said swing frame relative to said support frame comprises a hydraulically actuated cylinder assembly operatively interconnecting said support frame and said horizontally extendable member of said swing frame.

42. An attachment according to claim 31 wherein said means for angularly displacing said moldboard relative to said swing frame about said second axis is operatively connected to said swing frame at an elevated point.

43. An attachment according to claim 31 wherein said swing frame includes a post portion and said means for angularly displacing said moldboard relative to said swing frame about said second axis is operatively connected to said post portion.

44. An attachment according to claim 42 wherein said means for angularly displacing said moldboard relative to said swing frame about said second axis comprises a hydraulically actuated cylinder assembly operatively interconnected to a post portion at an elevated point and to said moldboard at a point intermediate the ends thereof.

45. An attachment according to claim 31 wherein said support frame includes a post portion and said means for displacing said moldboard relative to said swing frame about said first axis comprises a hydraulically actuated cylinder assembly operatively connected to said post portion at an elevated point and said moldboard at a point intermediate the ends thereof.

46. An attachment according to claim 1 wherein said swing frame includes a horizontally disposed beam section pivotally connected to said support frame and angularly displaceable relative to said support frame, a horizontally extendable beam member mounted on said beam section and displaceable horizontally relative to said beam section and a vertically extendable member mounted on said horizontally displaceable beam member and displaceable vertically relative to said horizontally displaceable beam member, to which said moldboard is connected, and including means for displacing said vertically displaceable member relative to said horizontally displaceable member.

47. An attachment for a vehicle comprising:

a support frame mountable on said vehicle;

a swing frame pivotally mounted on said support frame;

means for angularly displacing said swing frame relative to said support frame;

working means universally mounted on said swing frame;

means operatively interconnecting said support frame and said working means for angularly displacing said working means relative to said swing frame about a first axis; and means operatively interconnecting said swing frame and said working means for angularly displacing said working means relative to said swing frame about a second axis.

48. An attachment according to claim 47 wherein said support frame is detachably mountable on said vehicle.

49. An attachment according to claim 47 wherein said swing frame includes an extendable member onto which said working means is operatively connected.

50. An attachment according to claim 49 wherein said extendable member includes an extendable section onto which said working means is universally connected.

51. An attachment according to claim 47 wherein said swing frame is pivotally mounted on said support frame about an axis disposed laterally of a longitudinal centerline of said vehicle when said support frame is mounted on said vehicle.

* * * * *